US009694972B1

(12) United States Patent
Stravitz

(10) Patent No.: US 9,694,972 B1
(45) Date of Patent: Jul. 4, 2017

(54) RINGS FOR SECURING A BAG TO A CONTAINER

(71) Applicant: David M Stravitz, New York, NY (US)

(72) Inventor: David M Stravitz, New York, NY (US)

( * ) Notice: Subject to any disclaimer, the term of this patent is extended or adjusted under 35 U.S.C. 154(b) by 0 days.

(21) Appl. No.: 15/086,244

(22) Filed: Mar. 31, 2016

Related U.S. Application Data

(63) Continuation-in-part of application No. 29/556,087, filed on Feb. 26, 2016, now Pat. No. Des. 766,534.

(51) Int. Cl.
*B65F 1/06* (2006.01)
*B65F 1/16* (2006.01)

(52) U.S. Cl.
CPC ..... *B65F 1/06* (2013.01); *B65F 1/16* (2013.01); *B65F 2240/132* (2013.01)

(58) Field of Classification Search
CPC ..... B65F 1/06; B65F 1/16; B65F 2240/132; B65B 67/12
USPC ..... 220/495.08
See application file for complete search history.

(56) References Cited

U.S. PATENT DOCUMENTS 1,719,185 A 7/1929 Lowy
2,434,238 A 1/1948 Wolfson
2,793,373 A 5/1957 Ewing
3,134,548 A 5/1964 Medina et al.
3,214,065 A 10/1965 Thornton
3,893,649 A * 7/1975 Cornell ..... B65F 1/06 248/101
4,427,110 A 1/1984 Shaw, Jr.
4,488,697 A 12/1984 Garvey
D296,258 S * 6/1988 Nelson ..... D34/1
4,867,401 A * 9/1989 Graff ..... B65B 67/12 248/99
4,902,482 A 2/1990 Faust
5,174,462 A 12/1992 Hames
D334,975 S 4/1993 Bunce et al.
D344,624 S 3/1994 Schnel et al.
5,400,989 A * 3/1995 Gaskill ..... B65B 67/12 248/100
5,520,303 A 5/1996 Bernstein et al.
5,556,063 A * 9/1996 Boyd ..... B65B 67/1238 24/17 B (Continued)

*Primary Examiner* — Anthony Stashick
*Assistant Examiner* — Ernesto Grano
(74) *Attorney, Agent, or Firm* — Brian Roffe

(57) ABSTRACT

Ring for securing a bag to a waste container support includes an annular portion including an upper wall, an inner circumferential wall extending downward from an inner edge region of the upper wall and an outer circumferential wall extending downward from an outer edge region of the upper wall. An annular channel is defined on an underside of the annular portion. The inner and/or outer wall includes pinches each including a pair of slots extending upward from a lower edge of the wall. The slots are spaced apart from one another to enable a solid portion of the wall therebetween to temporarily flex outward, which aids in engagement and disengagement of the ring to a projection on the support, with a bag being sandwiched between the ring and projection and thereby secured to the support. Tabs may extend upward from the upper wall to aid in handling of the ring.

20 Claims, 20 Drawing Sheets

(56) References Cited

U.S. PATENT DOCUMENTS 5,662,238 A * 9/1997 Sarno ..... B65D 25/16 220/495.05
5,988,520 A 11/1999 Bitner
D457,283 S 5/2002 Wayt
6,484,374 B2 * 11/2002 McAllister ..... B65F 1/06 24/557
6,540,103 B2 4/2003 Silvers
6,612,099 B2 9/2003 Stravitz
D485,404 S 1/2004 Del Prato
6,679,462 B1 * 1/2004 Valdez ..... B65B 67/1211 248/101
6,804,930 B2 10/2004 Stravitz
6,851,251 B2 2/2005 Stravitz
6,904,867 B2 6/2005 Zamjahn
6,974,029 B2 12/2005 Morand et al.
7,086,569 B2 8/2006 Stravitz
7,114,314 B2 10/2006 Stravitz
7,146,785 B2 12/2006 Stravitz
D537,598 S * 2/2007 Moore ..... D34/10
7,225,943 B2 6/2007 Yang et al.
D559,494 S 1/2008 Yang et al.
7,316,100 B2 1/2008 Stravitz et al.
D567,466 S 4/2008 Lee
7,406,814 B2 8/2008 Morand
7,434,377 B2 10/2008 Stravitz et al.
D586,066 S 2/2009 Lin
7,503,152 B2 3/2009 Stravitz et al.
7,503,159 B2 3/2009 Stravitz et al.
7,516,865 B1 4/2009 Pierre
7,543,716 B2 6/2009 Lin
D596,364 S 7/2009 Morand
7,617,659 B2 11/2009 Stravitz et al.
7,696,711 B2 4/2010 Pollack et al.
7,708,188 B2 5/2010 Stravitz et al.
7,712,285 B2 5/2010 Stravitz et al.
D619,905 S 7/2010 Dunn et al.
7,878,359 B1 2/2011 Ko
7,931,150 B2 4/2011 Morand
D639,002 S 5/2011 Dunn et al.
D639,003 S 5/2011 Dunn et al.
D639,004 S 5/2011 Dunn et al.
7,963,414 B1 6/2011 Stravitz
D645,221 S 9/2011 Brown et al.
D652,189 S 1/2012 Morand
D653,009 S 1/2012 Larrivee et al.
D654,646 S * 2/2012 Williams ..... D34/6
D654,738 S 2/2012 Morand
8,127,519 B2 3/2012 Stravitz
D657,107 S 4/2012 Fitzpatrick et al.
8,215,089 B2 7/2012 Stravitz
8,235,237 B1 8/2012 Stravitz
8,266,871 B1 9/2012 Stravitz
8,272,686 B1 * 9/2012 Arnold ..... B60N 3/103 297/188.01
8,393,489 B1 3/2013 Stravitz
D682,725 S 5/2013 Reeder et al.
D683,099 S 5/2013 Wright et al.
D683,922 S 6/2013 Huang
8,567,157 B2 10/2013 Dunn et al.
8,635,838 B2 1/2014 Dunn et al.
8,647,587 B2 2/2014 Dunn et al.
8,657,139 B1 2/2014 Bodine
8,690,017 B2 4/2014 Dunn et al.
8,739,501 B2 6/2014 Dunn et al.
8,833,592 B2 9/2014 Dunn et al.
8,834,023 B1 9/2014 Laera
8,844,751 B2 9/2014 Sakaguchi et al.
8,899,420 B2 12/2014 Morand
8,910,821 B1 12/2014 Stravitz
D722,735 S 2/2015 Del Rosario Roy et al.
D723,239 S 2/2015 Raschke et al.
8,959,880 B2 2/2015 Morand
8,973,774 B1 3/2015 Stravitz
D728,184 S 4/2015 Hoggatt et al.
9,085,404 B2 7/2015 Dunn et al.
D737,013 S 8/2015 Beumer
D739,632 S 9/2015 Senser
D747,060 S 1/2016 Valderrama et al.
D763,520 S * 8/2016 Runyan ..... D30/162
2002/0051739 A1 5/2002 Wang
2005/0082196 A1 4/2005 Lin
2008/0134644 A1 6/2008 Knuth et al.
2009/0046955 A1 2/2009 Schember et al.
2009/0071959 A1 3/2009 Cheung
2010/0005762 A1 1/2010 Stravitz
2010/0140423 A1 6/2010 Davies
2011/0099945 A1 5/2011 Dunn et al.
2011/0099958 A1 5/2011 Dunn et al.
2012/0211494 A1 8/2012 Morand
2013/0048641 A1 2/2013 Romano
2013/0168396 A1 * 7/2013 Quan ..... B65F 1/1607 220/495.11
2013/0181000 A1 7/2013 Miksovsky et al.
2013/0252534 A1 9/2013 Smith
2014/0027452 A1 1/2014 Pan
2014/0042168 A1 2/2014 Dunn et al.
2015/0368041 A1 12/2015 Coffin

* cited by examiner

RINGS FOR SECURING A BAG TO A CONTAINER

CROSS-REFERENCE TO RELATED APPLICATION

This application is a continuation-in-part of U.S. patent application Ser. No. 29/556,087 filed Feb. 26, 2016, which is incorporated by reference herein.

FIELD OF THE INVENTION

The present invention relates generally to a securing member that secures or traps a bag to a container so that the bag does not fall into the container during use and more specifically to a ring that secures a bag to a waste container so that the bag does not fall into the waste container when waste is inserted. The waste container may be used for any type of waste, including but not limited to, cat litter, medical waste from hospitals, doctors' offices, home health care personnel and facilities, nursing homes, biohazard laboratories, diapers, general household waste, disposables and the like, and includes a single use bag that is sought to be secured to the container.

BACKGROUND OF THE INVENTION

Waste disposal devices are common in hospitals, doctors' offices, kitchens and other household locations and other locations where waste is generated and must be disposed of in a sanitary manner. Waste disposal devices are also often used to dispose of household waste, baby diapers, adult disposables, cat litter and other pet waste.

Some waste disposal devices include a dispenser that dispenses tubing, and therefore include an internal ring-shaped flange on which a tubular core or cartridge rests and houses a continuous length of flexible, substantially non-resilient plastic tubing. A knot is tied at one end and the continuous tubing is pulled down to the bottom of the pail to form a bag for inserting one diaper after another until the bag is full. When full, you cut the top of the bag with a built in blade and then tie a knot in the open area for subsequent removal. This procedure is once again repeated-tie the knot-fill the bag-remove the bag, etc. When the canister is depleted of bag lengths, one replaces the canister. Canisters are costly and require changing regularly.

Another disposal device utilizes a single use bag sealed at one end and is welded to a foldable plastic header at the open end. The header when opened flat rests securely in the pail to accept diapers as they fill up. Once full, the plastic header folds to seal the upper open area and at the same time forms a handle for convenient removal. These polypropylene living hinge headers are wasteful, costly to produce and require welding or bonding them to a one-time use bag.

Numerous waste disposal devices exist including those disclosed in U.S. Pat. Nos. 6,612,099, 6,804,930, 6,851,251, 7,086,569, 7,114,314, 7,146,785, 7,316,100, 7,434,377, 7,503,152, 7,503,159, 7,617,659, 7,708,188, 7,712,285, 7,963,414, 8,127,519, 8,215,089, 8,235,237, 8,266,871, 8,973,774 and all of which are incorporated by reference herein. Additionally, innovative waste disposal devices are disclosed in U.S. patent application Ser. No. 12/172,715 filed Jul. 14, 2008, now abandoned, Ser. No. 13/172,976 filed Jun. 30, 2011, now abandoned, and Ser. No. 13/270,697 filed Oct. 11, 2011, now abandoned, all of which are incorporated by reference herein.

Some of these waste disposal devices include a base defining a waste-receiving compartment and a lid pivotally connected to the base. When the lid is opened, a bag becomes visible and waste is inserted into an opening of the bag. The bag often passes through a membrane that requires force to insert the waste, and also serves to close the bag above the waste providing a barrier to waste and odor outflow. In some waste disposal devices, the bag is actually part of an accordion-folded length of flexible tubing that is housed in a cartridge.

Further, some of these waste disposal devices include a step or foot pedal assembly to complement or replace the manual opening and closing of the lid. The foot pedal assembly includes a depressible foot pedal and a spring, and is arranged to cause both opening of the lid when the foot pedal is depressed and closure of the lid when the pressing force is removed. The spring is moved against its bias upon depression of the foot pedal and returns to its original state when the pressing force is removed to thereby cause closure of the lid and rotation of the twisting mechanism.

In addition, in some conventional pails, release of the foot pedal or a similar step pedal does not cause twisting of a bag housed in the pail. Rather, when the user steps on the pedal, the lid remains open and no twisting of the bag occurs. The user must close the lid with their hand(s) in order to cause a twist in the bag.

SUMMARY OF THE INVENTION

A ring for securing a bag to a support in a container in accordance with the invention includes an annular portion including an upper wall, an inner circumferential wall extending downward from an inner edge region of the upper wall and an outer circumferential wall extending downward from an outer edge region of the upper wall. An annular channel is defined on an underside of the annular portion by the inner and outer walls and the upper wall. At least one pinch is situated on the inner or outer wall and each pinch includes a pair of slots extending upward from a lower edge of the wall. The slots are spaced apart from one another to enable a solid portion of the wall between the slots to temporarily flex outward. Also, the slots may extend from the lower edge of the wall only partly to the upper wall. One or more pinches may be formed on only the outer wall, on only the inner wall or on one or more of each of the inner and outer walls.

In some embodiments, one or more detents are formed each on an inner surface of the inner or outer wall in a portion of the wall between the slots of each pinch. The detent may be situated on the portion of the outer wall between the slots when the pinch is formed on the outer wall and projects inward into the channel or on the portion of the inner wall between the slots when the pinch is formed on the inner wall and projects outward into the channel. Each detent may be curved in a horizontal orientation, straight in a horizontal orientation, or a horizontal or vertical rib. The detent may be situated anywhere along the portion of the inner or outer wall between the slots. One or more optional upright tabs may extend upward from the upper wall. Each tab may be associated with a respective pinch. The tab may include a flange and two supports for supporting the flange on the upper wall, and the upper wall includes an opening above the respective pinch and between the supports.

Some tabs may include a flange having an inner surface contiguous with an inner surface of the inner wall, and supports extending radially outward from the flange to an outer edge region of the upper wall proximate the outer wall.

Other tabs may include a flange having an outer surface contiguous with an outer surface of the outer wall, and supports extending radially inward from the flange to an inner edge region of the upper wall proximate the inner wall.

The ring may be used in combination with a waste container having a support for supporting a bag-securing member, the ring securing a bag to the support by securing the bag to a projection of the support. The annular portion is thus configured to press the bag against the support by trapping the bag in the channel and engaging with the support such that the projection of the support is pressed into the channel to thereby sandwich the bag between the projection and the annular portion.

Another embodiment of a ring for securing a bag to a support in a container in accordance with the invention includes an annular portion including an upper wall, an inner circumferential wall extending downward from an inner edge region of the upper wall and an outer circumferential wall extending downward from an outer edge region of the upper wall. An annular channel is defined on an underside of the annular portion by the inner and outer walls and the upper wall. Upright tabs extend upward from the upper wall. An extension rib is arranged on an outer radial surface of each upright tab and defines a support for a top of the container. The annular portion has a first state engaged with the support in which the extension rib is able to support the top of the container and a second state entirely free of the support and is movable between the first and second states by grasping one or more of the upright tabs.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
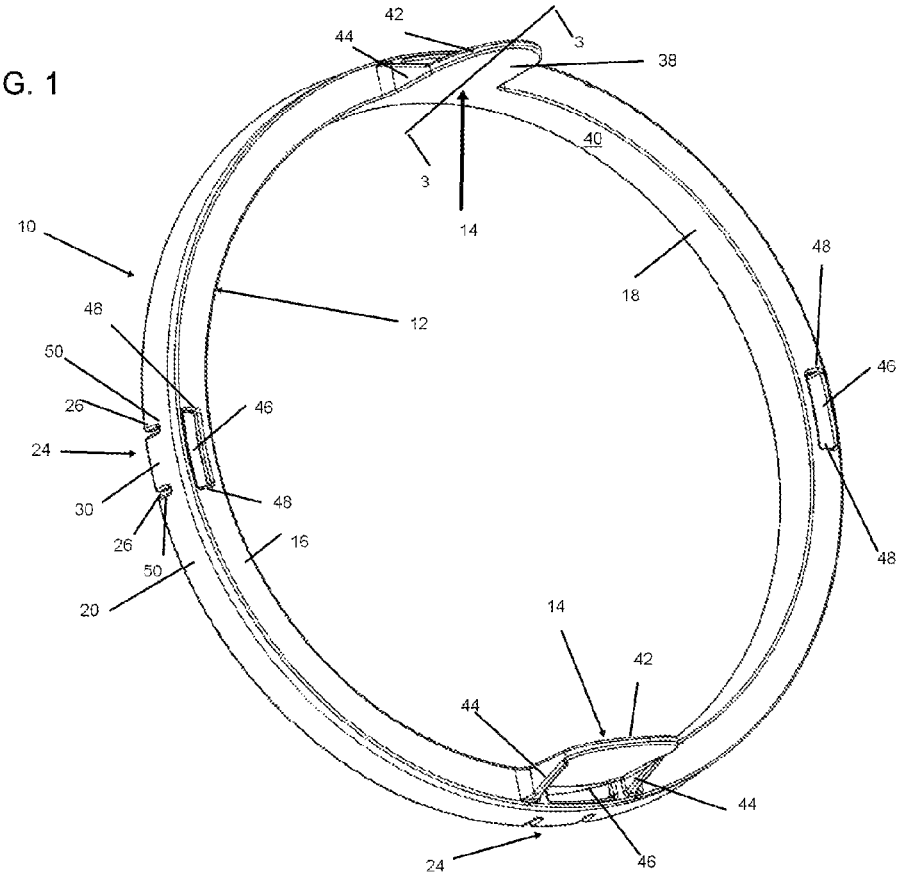
FIG. 1 is a perspective view of a first embodiment of a ring for securing a bag to a container in accordance with the invention.

Referring to the accompanying drawings wherein like reference numerals refer to the same or similar elements, a first embodiment of a ring for securing a bag to a support in a container in accordance with the invention is designated generally as 10 and includes an annular portion 12 and two upright tabs 14 that facilitate handling of the annular portion 12 to engage with the support of the container. Annular portion 12 may be circular as shown or have a different shape, e.g., rectangular, square or oval. The shape and size of the annular portion 12 depends on the shape and size of the support of the container in conjunction with which the ring 10 will be used (described with reference to FIGS. 4-7).

Annular portion 12 includes an upper wall 16, an inner circumferential wall 18 extending downward from an inner edge region of the upper wall 16 and an outer circumferential wall 20 extending downward from an outer edge region of the upper wall 16. A channel 22 is defined on the underside of the annular portion 12 between the inner and outer walls 18, 20 and the upper wall 16 (see FIG. 2). The inner and outer walls 18, 20 may be concentric so that the channel 22 has a substantially constant width around the circumference of the annular portion 12.

To facilitate removably securing a bag to the support of the container, the outer wall 20 includes one or more spring-like pinches 24. Each pinch 24 includes two substantially parallel slots 26 that each extend upward from a lower edge 28 of the outer wall 20 thereby providing a solid portion 30 of the outer wall 20 therebetween (see FIGS. 1 and 3). By mentioning that the slots 26 are substantially parallel to one another, it is intended that this phrase covers embodiments wherein the slots 26 are either exactly parallel to one another or that they may be at a slight angle to one another, i.e., by drawing a line through the center of each slot 26, the lines would intersect at a small angle, which angle does not detract from their ability to cause the solid portion 30 between the slots 26 to be provided with some flexibility and thereby be able to flex outward during placement of the ring 10 into engagement with a container.

The slots 26 extend toward the upper wall 16 but, as shown, do not reach the upper wall 16, although this is a possibility. The edges of the slots 26 are smooth, or smoothed to avoid sharp edges that may tear a bag. The slots 26 may be formed when molding the ring 10 from a resilient thermoplastic material such as, for example, polypropylene.

In some embodiments, the pinches 24 are configured to compensate for draft angles of the support present in conventional and existing waste disposal devices particularly used to dispose of diapers, e.g., of the Playtex DIAPER GENIE® type as well as other manufacturers.

Figure 3:
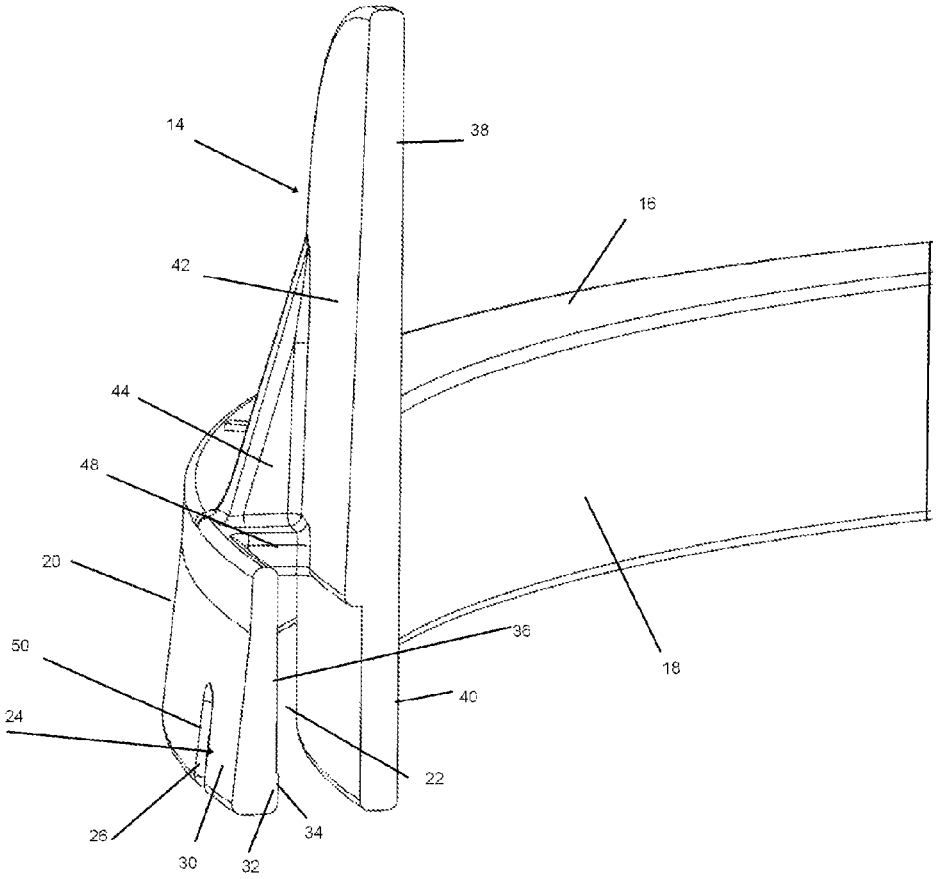
FIG. 3 is a cross-sectional view of the ring shown in FIG. 1 taken along the line 3-3 in FIG. 1.

A bottom edge region 32 of the outer wall 20, in that portion 30 between the slots 26, preferably includes a small bump, ridge or detent 34 on an inner surface 36 (see FIG. 3). The detent 34 may be a half-round bump as more clearly seen in FIG. 9. The half-round bump has a curvature that is at a maximum in a center of the portion 30 of the outer wall 20 between the slots 26 and tapers toward the slots 26. The detent 34 may also be formed by a bump with a straight, non-tapering surface extended into the channel 22 The detent 34 can thus be a ridge that projects a constant depth into the channel 22 from the inner surface 36 of the portion 30 toward the opposite edge of the channel 22, i.e., the outer surface of the inner wall 18.

This detent 34 adds to the ability of the outer wall 20 to hold and apply pressure to a bag that is operatively sandwiched between the outer wall 20 and a projection of the support of the container to which the bag is secured (see FIGS. 4-7 discussed below). Also, the detent 34 can compensate for the draft angle issue for both the molded part which requires suitable draft angles, as well as the necessary draft angles of the DIAPER GENIE® insert(s) and possibly other inserts by other manufacturers where a bag may funnel into a waste pail.

The position of the detent 34 at the bottom edge region 32 of the outer wall 20, in that portion 30 between the slots 26, is not limiting and other positions for the detent 34 are also possible and envisioned as being within the scope and spirit of the invention. For example, the detent 34 may be situated anywhere along the outer wall 20 in that portion 30 between the slots 26. This portion may be referred to as a shutoff area. The detent 34 could be approximately halfway up from the lower edge of the outer wall 20 on the inner surface of the outer wall 20.

Figure 4:
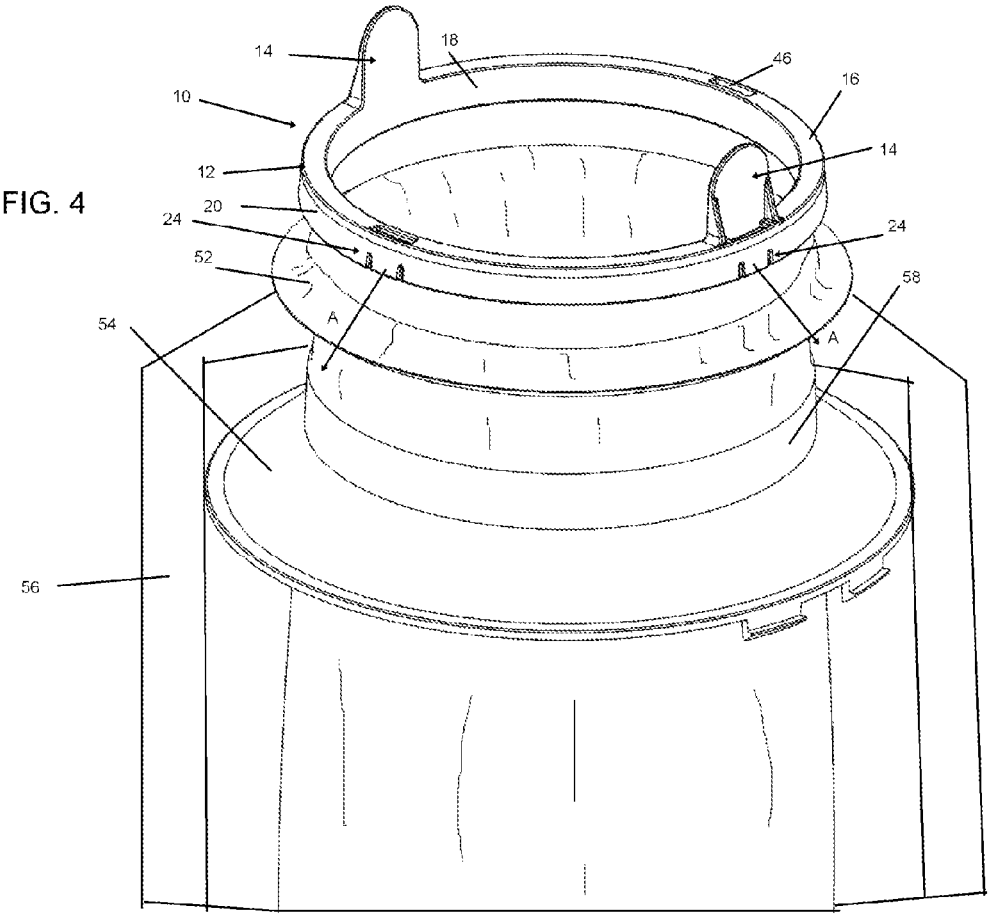
FIG. 4 is a view showing the ring of FIG. 1 about to secure a bag to a support in a waste container.
Figure 5:
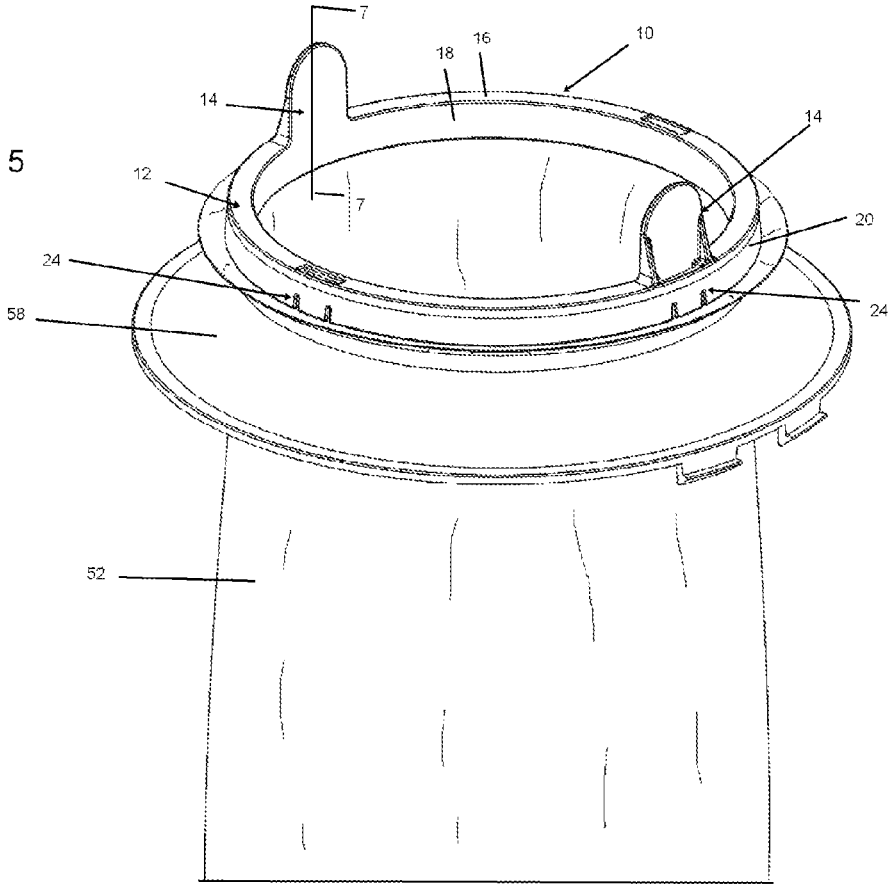
FIG. 5 is a view showing the ring of FIG. 1 securing the bag to the support in the waste container.

With the formation of the pinches 24, the slots 26 allow the ring 10 to flex outward or spring out locally at the region of the pinches 24 to enable the outer wall 20 to be placed over the bag which is wrapped over the projection of the support of the container to which the bag is secured (in the direction of arrows A in FIG. 4). To this end, the slots 26 should not be spaced apart too far from one another, their height from the lower edge 28 of the outer wall 20 inward toward the upper wall 16 should be sufficient, and the angle of extension toward the upper wall 16 should be the same or very close to one another to enable flexure of the solid portion 30 between the slots 26. The exact range of distances between the slots 26, the height of the slots 26 and the angles of extension to enable the slots 26 to flex temporarily can be readily determined by one skilled in the art in view of the disclosure herein, and the identified purpose of the slots 26.

Figure 2:
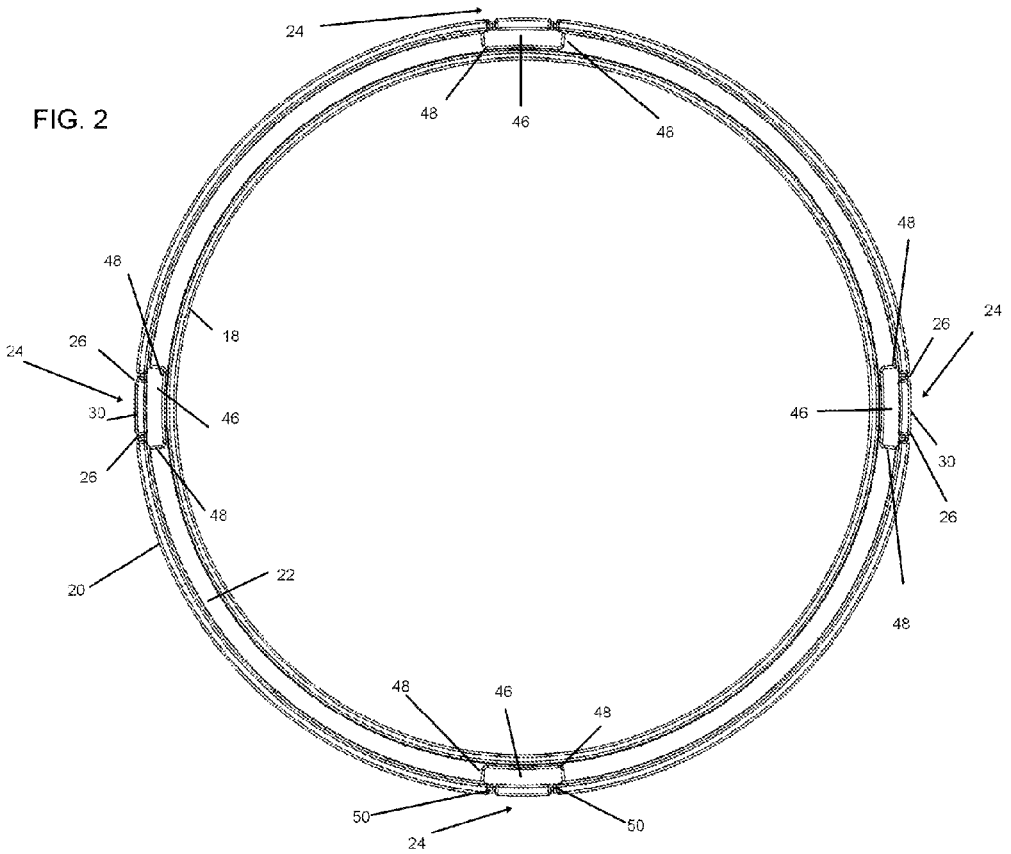
FIG. 2 is a bottom view of the ring shown in FIG. 1.

The outward flexure of the outer wall 20 at the area of the pinches 24 is only temporary and the pinches 24 will spring back to their initial state shown in FIG. 2 after engaging with the bag, at which time, the internal detent 34 will exert force against the projection of the support of the container to which the bag is secured causing a more positive pinch or engagement to the support, with the bag sandwiched therebetween (see FIG. 7, discussed below).

The tabs 14 extend upward from the upper wall 16 and have an inner surface 38 that may be contiguous with the inner surface 40 of the inner wall 18 of the annular portion 12 (see FIGS. 1 and 3). Each tab 14 includes a flange or flange portion 42 defining the inner surface 38 of the tab 14 and a pair of supports 44. The flange portion 42 extends along a small circumferential portion of the inner wall 18 and has a depth less than the thickness of the upper wall 16. The supports 44 extend radially outward from the flange portion 42 to an outer edge region of the upper wall 16 proximate the outer wall 20 (see FIGS. 1 and 3).

Tabs 14 may be arranged at the same circumferential locations as pinches 24. As shown in FIG. 1, two tabs 14 are arranged on diametrically opposite parts of the ring 10 and one of the pinches 24 is aligned with each tab 14. For these pinches 24, the slots 26 of the pinches 24 are situated slightly inward of each of the supports 44. One reason for this is because an opening 46 is formed in the upper wall 16 in a position such that edges 48 of the opening 46 substantially align with or are only slightly outward of outer edges 50 of the slots 26 (see FIGS. 1-3). There is thus an opening 46 in the upper wall 16 above at least part of the pinches 24, and the flange portion 42 is radially inward of the opening 46 (see FIG. 1) and thus the supports 44 must therefore be spaced outward from the slots 26, and alongside the edges 48 of the opening 46.

By mentioning that the two tabs 14 in the embodiment shown in FIG. 1 are arranged on diametrically opposite parts of the ring 10, it is intended that this phrase covers embodiments wherein the tabs 14 are either exactly diametrically opposite one another or that there may be a slight deviation from a 180 degree angle between the radial line extending from a center of the annular portion 12 to the center of each tab. A 180 degree angle would mean that the tabs 14 align with one another. The position of the two tabs 14 is, overall, designed to optimize the ease with which the ring 10 may be used to place it onto a container and remove it from engagement with a container, and a slight deviation from diametrically opposite tabs 14 will continue to allow for such optimal ease of use.

Other pinches 24 do not include an associated tab 14. By associated, it means that the flange portion 42 of the tab 14 is radially inward of the opening 46 formed above the pinch 24 along the same radial line from a center of the annular portion 12. Thus, the flange portion 42 of a tab 14 associated with a pinch 24 is inward of and alongside the opening 46 above the pinch 24. The number of tabs 14 and pinches 24 may be selected as desired, and placement of tabs 14 in association with pinches 24 is an optional feature. Thus, it is possible to include in a ring the same number of tabs 14 and pinches 24 with each tab 14 being associated with a respective pinch 24, the same number of tabs 14 and pinches 24 with none of the tabs 14 being associated with any of the pinches 24, the same number of tabs 14 and pinches 24 with only a portion of the tabs 14 being associated with a respective pinch 24, a higher number of pinches 24 than tabs 14 with either none, only a portion of all of the tabs 14 being associated with a respective pinch 24, or a lower number of pinches 24 than tabs 14 with either none, only a portion of all of the tabs 14 being associated with a respective pinch 24. Moreover, it is possible to position the pinches 24 around the circumference of the outer wall 20 as desired, whether with a common spacing therebetween, irregularly spaced or however the user wants.

With respect to manufacture of the ring 10, a preferred manufacturing technique is to injection-mold the ring 10. Injection molded parts can be produced and ejected from a mold after curing, formation and cooling in view of the presence of a draft or taper. Injection-molded parts cannot come out from the mold unless they are ejected with a certain amount of taper. Sometimes, in order for a part to come out with minimal scraping, tools are constructed with anywhere from about a ¾" per side draft or even more. This is especially true with parts that are shiny smooth or crystal clear. Parts with about a ⅕" draft per side (about 5 degrees per side) may have scrape marks or even get stuck in the mold and cause serious interruption in the molding cycle.

To address these production issues while still enabling the ring 10 to be made by an injection molding process, the ring 10 is molded with a shutoff thereby eliminating costly cam action injection molds, which allow the internal detent 34 to be formed by steel in the mold going through the opening 46 and thus forming the internal detent 34 with steel meeting it through the bottom. Use of shutoffs in injection molding is common as a practical, economical alternative to side action cam tools (molds). It is possible to form the internal detent 34 and the slots 26 without shutoffs but this can pose molding issues due to the small space to achieve this.

Ring 10 may serve a similar function as a closure component shown in FIGS. 45-48 of U.S. patent application Ser. No. 14/709,878 filed May 12, 2015, and Ser. No. 14/935,835 filed Nov. 9, 2015, both of which are incorporated by reference herein. This closure component, designated 242A, is free standing and can secure a bag to an insert of a waste container as disclosed therein.

FIG. 4 shows the ring 10 in a position in which is about to secure a bag 52 to a support 54 in a waste container 56 (not fully shown). Waste container 56 may be those disclosed in U.S. patent application Ser. No. 14/709,878 filed May 12, 2015, and Ser. No. 14/935,835 filed Nov. 9, 2015. It is noted that the ring 10 is not limited to any particular use, and disclosure of use of the ring 10 in connection with a container and specifically a waste container is a preferred use since waste containers, and even more specifically diaper pails, exist with the structure complementary to the ring 10 to enable the ring 10 to engage with them.

Generally, the waste container 56 that can be used with the ring 10 includes the support 54 which is attached thereto and typically supports a cartridge of flexible tubing which forms a plurality of waste-receiving bags. As an example, the bag 52 may be dimensioned to fit existing waste disposal devices, including those specifically adapted for diapers, such as the Playtex DIAPER GENIE® pail, the Playtex Litter Genie™ pail and the Munchkin Arm & Hammer™ pail. The combination of the ring 10 and bag 52 would effectively replace a cartridge or canister of continuous flexible tubing used with such waste disposal devices, as well as replace the foldable single use polypropylene header welded to a single use pleated bag used in some of those waste disposal devices.

Figure 7:
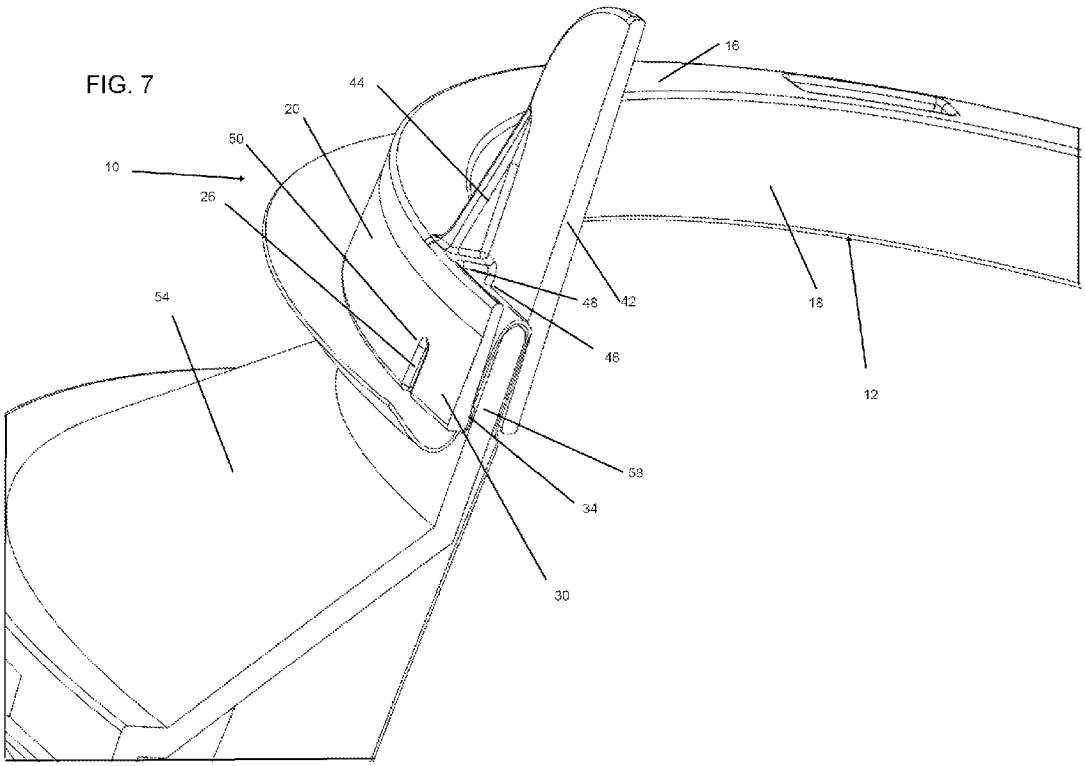
FIG. 7 is a cross-sectional view of the ring shown in FIG. 1 secured to the support of the waste container taken along the line 7-7 in FIG. 5.

By appropriate dimensioning and formation of the channel, it is possible to engage the ring 10 with a projection 58 of the support 54 of existing diaper pails while the bag 52 is secured therebetween (see FIGS. 4 and 7). The support 54 is normally used, for example, to support a cartridge of flexible tubing. Such a cartridge of flexible tubing is not shown. The projection 58 may be formed on structure other than a support for a cartridge of flexible tubing. For example, the projection may be part of a molded part of a waste container, e.g., a part that engages with a Munchkin brand waste container with four rigid or flexible tabs. The projection 58 may also be part of a structure that is adapted to engage with conventional waste containers, e.g., in the form of an adapter that enables use of the ring 10. This retrofit embodiment does not alter the essence of the invention as the projection 58 may either be built into a waste container or provided by structure that can be attached to the an existing waste container.

Replacement of the cartridge of continuous flexible tubing by a single use bag 52 as in the invention is advantageous because it eliminates the need to repeatedly cut and tie the tubing after the waste compartment is full. When using tubing, after the waste compartment is full, the user must cut the tubing, tie the cut end of the tubing to close the tubing with waste in it, and tie the other cut end of the tubing to form a new bottom of a bag, This must occur as long as there is tubing in the cartridge, about 8-10 bags full of waste. The invention alters this by replacing tubing with single use bags 52, and the multi-use, long-lasting ring 10. Indeed, it is expected that the ring 10 might be used with hundred or even thousands of bags 52 before it is no longer usable. This also eliminates waste from replacing cartridges of tubing. It also reduces the carbon footprint and saves natural resources that may wind up in landfills. Both the DIAPER GENIE® and Munchkin canisters, as well as Munchkin folding plastic headers are generally not recyclable. As such, when disposed of, they are typically buried with other non-recyclables in landfills through the country.

Figure 6:
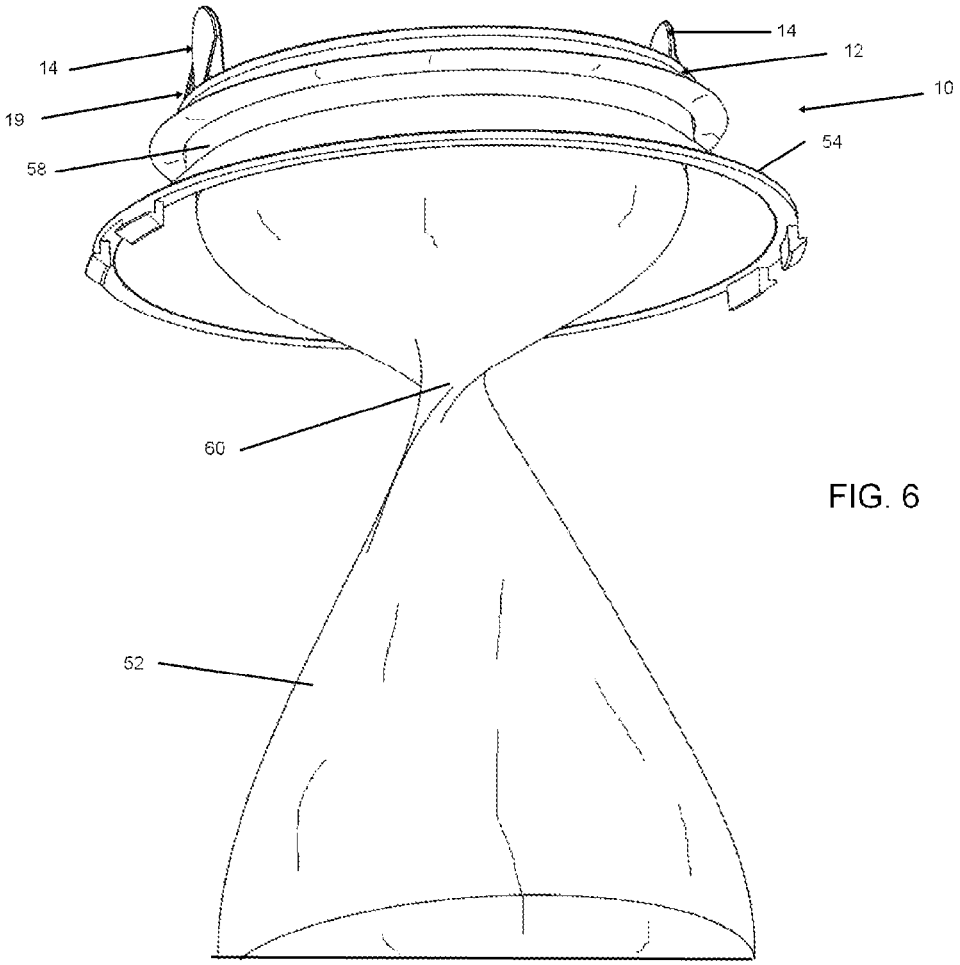
FIG. 6 is a bottom perspective view similar to FIG. 5 but also showing formation of a twist in the bag that can be enabled by rotation of the ring relative to the support of the waste container.

FIG. 6 shows formation of a twist 60 in the bag 52 which can be enabled by rotation of the ring 10 relative to the support 54 of the waste container 56. The ring 10, provided it is round such as shown, can be rotated relative to the support 54 to cause a temporary twist, and maybe a knot, in an upper region of the bag 52. Rotation of the ring 10 is aided by the tabs 14. To wit, the tabs 14 can be grasped and then turned to cause rotation of the ring 10.

An advantage of rotating the ring 10 to form the twist 60 is that prior to removal of the filled bag with waste down below, the temporary twist 60 will allow the user to keep in (keep down) offensive smell emanating from the waste in the bag 52.

In use, the user could create the temporary twist 60 by rotating the ring 10 relative to the support 54, then remove the ring 10 and form a more permanent knot in the bag 52. Soiled diapers, for one example, could be very offensive when dealing with an open bag in the upper region. Forming a temporary twist 60 can significantly minimize this issue.

Ring 10 with tabs 14 is designed to simplify use of a waste disposal device, and specifically a diaper pail. Often, with conventional diaper pails using cartridges, changing the cartridge requires physically removing the top/lid assembly, placing and removing the cartridge and then once more snapping the top/lid assembly back in place. Ring 10 with tabs 14 eliminates this application insofar as a single use bag is used, secured to the structure of the diaper pail that will support the cartridge, and the tabs extend upward through the opening of the diaper pail. The tabs 14 are easily accessed through the opening to aid in both engagement and securing of the ring 10 to the projection 58 of the support 54 and release of the ring 10 from engagement with the projection 58 of the support 54 (when the bag 52 is full and needs to be replaced).

By suitable position of the tabs 14, e.g., in diametrically opposite positions as shown in FIGS. 1-9 and 11, the tabs 14 can be both grasped and squeezed inward causes the portion of the outer wall 20 between the slots 26 of the pinches 24 associated with the tabs 14 to move outward sufficiently to relax the internal detent 34 and thereby minimize the pinch 24. This causes the pinch 24 to move from an engaging state with the bag 52 to a slightly disengaging state from the bag 52 for easing removal of the ring 10 from the projection 58. Application of inward squeezing pressure to the tabs 14, while beneficial to aid in engagement and disengagement of the ring 10 to the projection 58 of the support 54 is not essential. It is also possible to simply press the ring 10 down to engage it with the projection 58 of the support 54, and then lift it up to disengage it from the projection 58 of the support 54.

Figure 8:
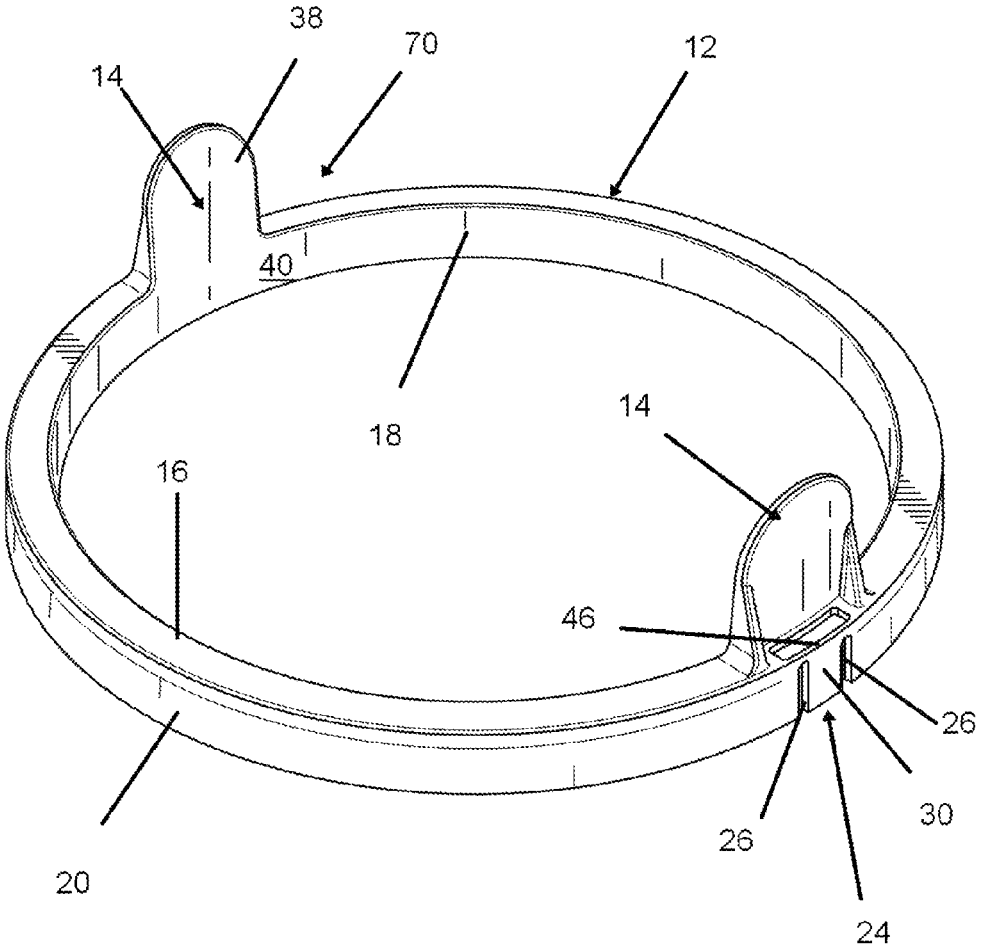
FIG. 8 is a perspective view of a second embodiment of a ring for securing a bag to a container in accordance with the invention.
Figure 9:
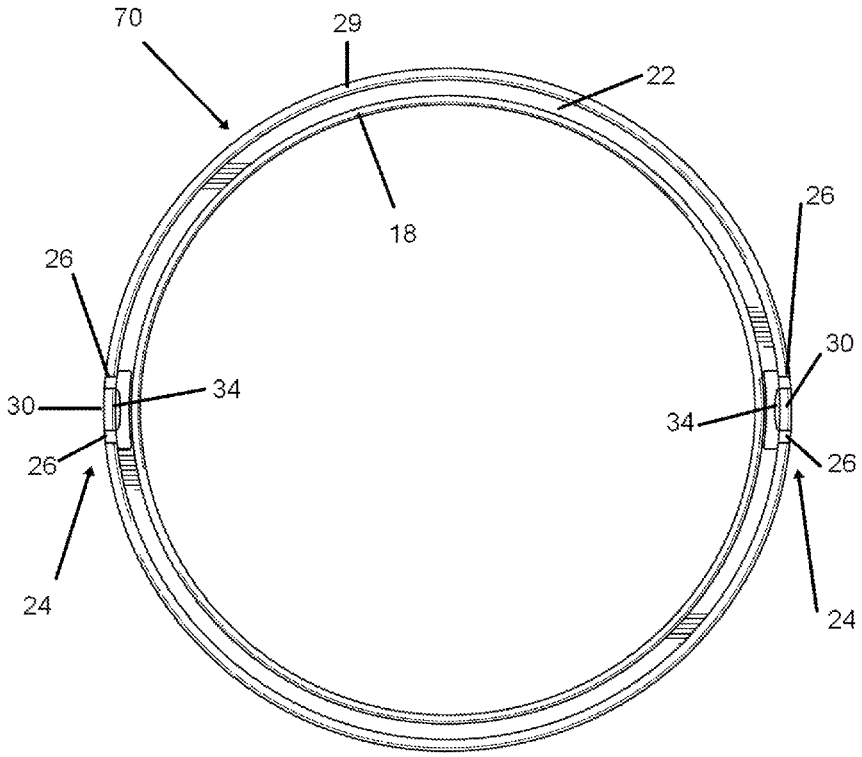
FIG. 9 is a bottom view of the ring shown in FIG. 8.

FIGS. 8 and 9 show a ring 70 that has the same number of tabs 14 and pinches 24, e.g., two diametrically opposite one another, with each tab 14 being associated with a respective pinch 24. Otherwise, i.e., except for the slots 26 of each pinch 24, the outer wall 20 of the annular portion 12 is solid, see FIG. 9. The positioning of the tabs 14 and associated pinches 24 diametrically opposite one another is a preferred option and the relative placement of the tabs 14 and associated pinches 24 may differ from a diametrically opposite placement.

Figure 10:
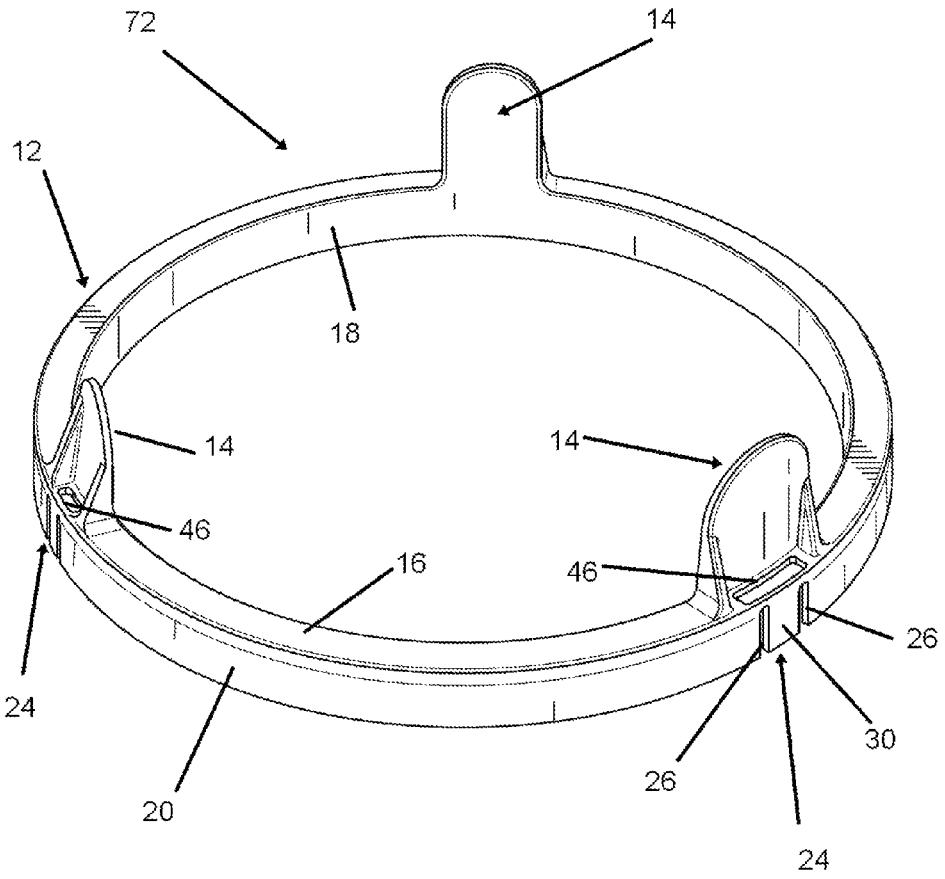
FIG. 10 is a perspective view of a third embodiment of a ring for securing a bag to a container in accordance with the invention.

FIG. 10 shows a ring 72 that has the same number of tabs 14 and pinches 24, e.g., three, with each tab 14 being associated with a respective pinch 24. Otherwise, i.e., except for the slots 26 of each pinch 24, the outer wall 20 of the annular portion 12 is solid. The tabs 14 and associated pinches 24 are positioned equiangularly about the circumference of the annular portion 12, i.e., spaced equiangularly apart from one another. Thus, there is about a 120 degree angle between adjacent radial lines extending from a central axis of the ring 10 to the center of each flange portion 42 of the tabs 14.

Figure 11:
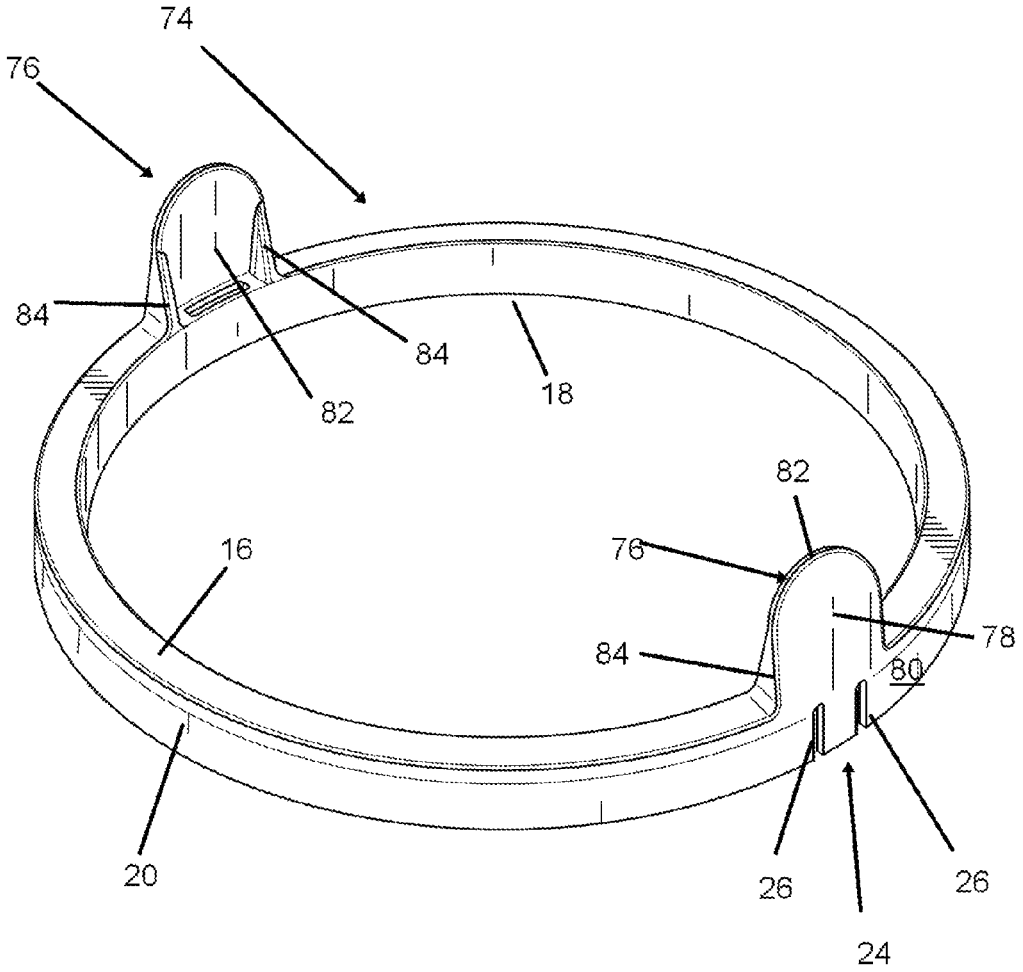
FIG. 11 is a perspective view of a fourth embodiment of a ring for securing a bag to a container in accordance with the invention.

FIG. 11 shows a ring 74 that has the same number of tabs 76 and pinches 24, e.g., two diametrically opposite one another, with each tab 76 being associated with a respective pinch 24. In this embodiment, the tabs 76 are formed with their outer radial surface 78 contiguous with the outer surface 80 of the outer wall 20, i.e., a flange portion 82 of each tab 76 is radially outward of the opening 46. Supports 84 therefore extend inward from the flange portion 82 toward the center of the ring 74, and end proximate the inner edge region of the inner wall 18. For tabs 76, it would be easier for the user to press their fingers against the flange portions 82 and squeeze the tabs 76 toward one another.

Figure 12:
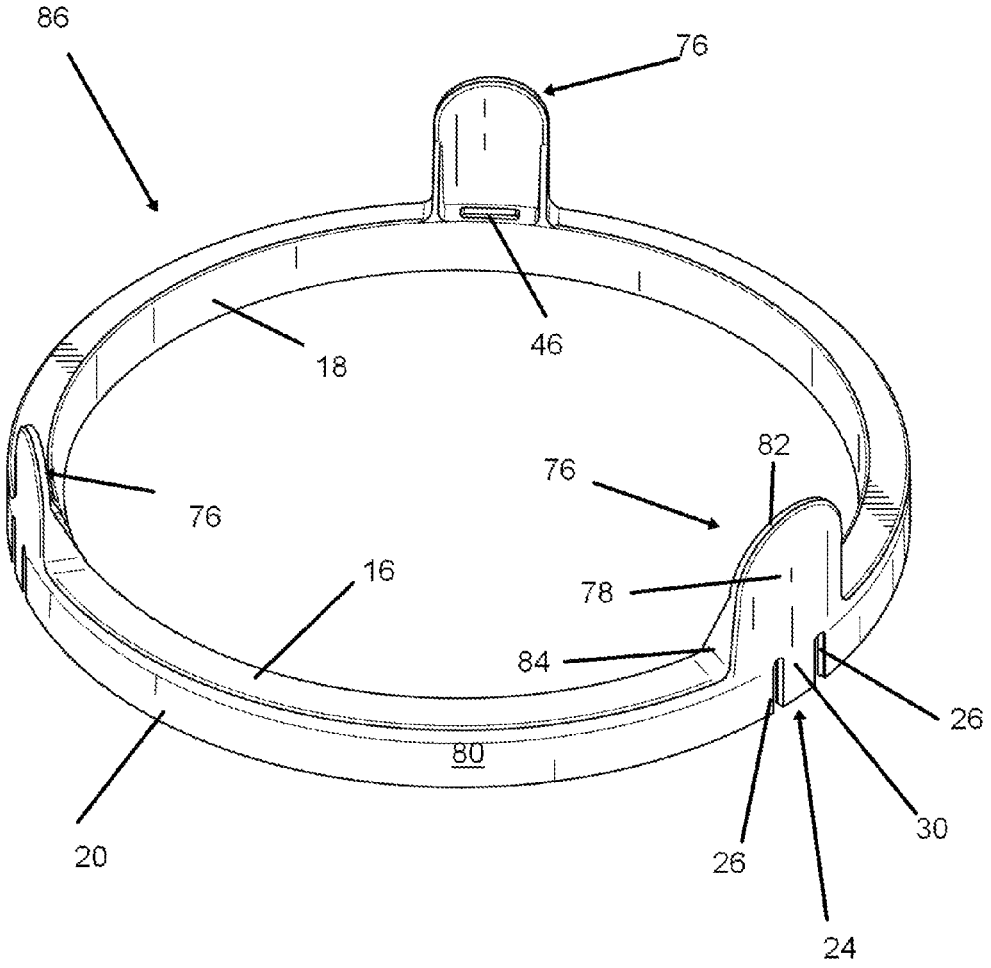
FIG. 12 is a perspective view of a fifth embodiment of a ring for securing a bag to a container in accordance with the invention.

FIG. 12 shows a ring 86 with three tabs 76 such as shown in FIG. 11 but arranged like tabs 14 in FIG. 10.

FIGS. 11 and 12 also show the presence of a small radius on the flange portions 82 when they meet with the upper wall 16 of the annular portion 12. This small radius is a result of the injection molding process.

It should be clear that the different tabs 14, 76 disclosed above may be used in any of the configurations of tabs 14, 76 shown in FIGS. 1-12 and there is no limitation to specific tabs in specific locations. A different number of tabs 14, 76 may be used in a ring in accordance with the invention, whether only a single tab or four or more tabs. The tabs 14, 76 should extend upward from the upper wall 16 a distance of an inch or so to enable the fingers of the user to engage with the flange portion 42 and be able to effectively press inward or outward to increase the space between the solid portion 30 of the outer wall 20 between the slots 26 and the inner wall 18 and thereby more easily allow the ring 10 to be pressed onto the projection 58 and to more easily allow the ring 10 to be disengaged from a state securing the bag 52 to the projection 58. The circumferential length of the flange portion 42 may also be about one inch or so for a ring 10 designed for a conventional diaper pail. A large diameter annular portion may have larger flanges, in both their circumferential length and height. The specific dimensions of the flanges relative to the annular portion could be readily ascertainable by those skilled in the art to which this invention pertains in view of the identified purpose of the flanges disclosed herein.

Figure 13:
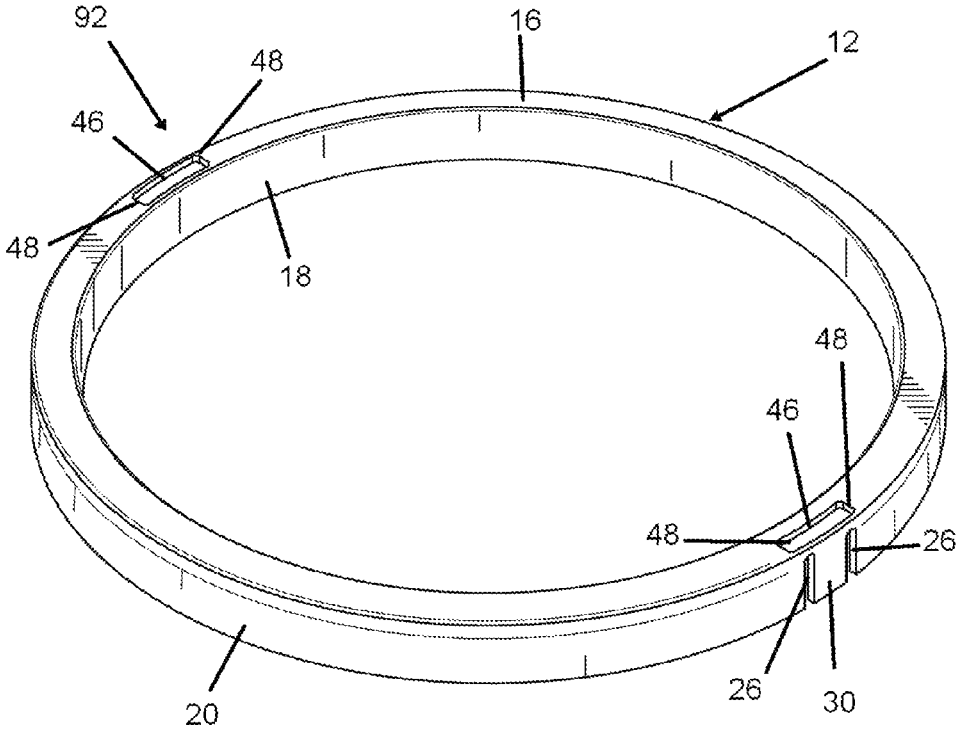
FIG. 13 is a top perspective view of a sixth embodiment of a ring for securing a bag to a container in accordance with the invention without any tabs.
Figure 14:
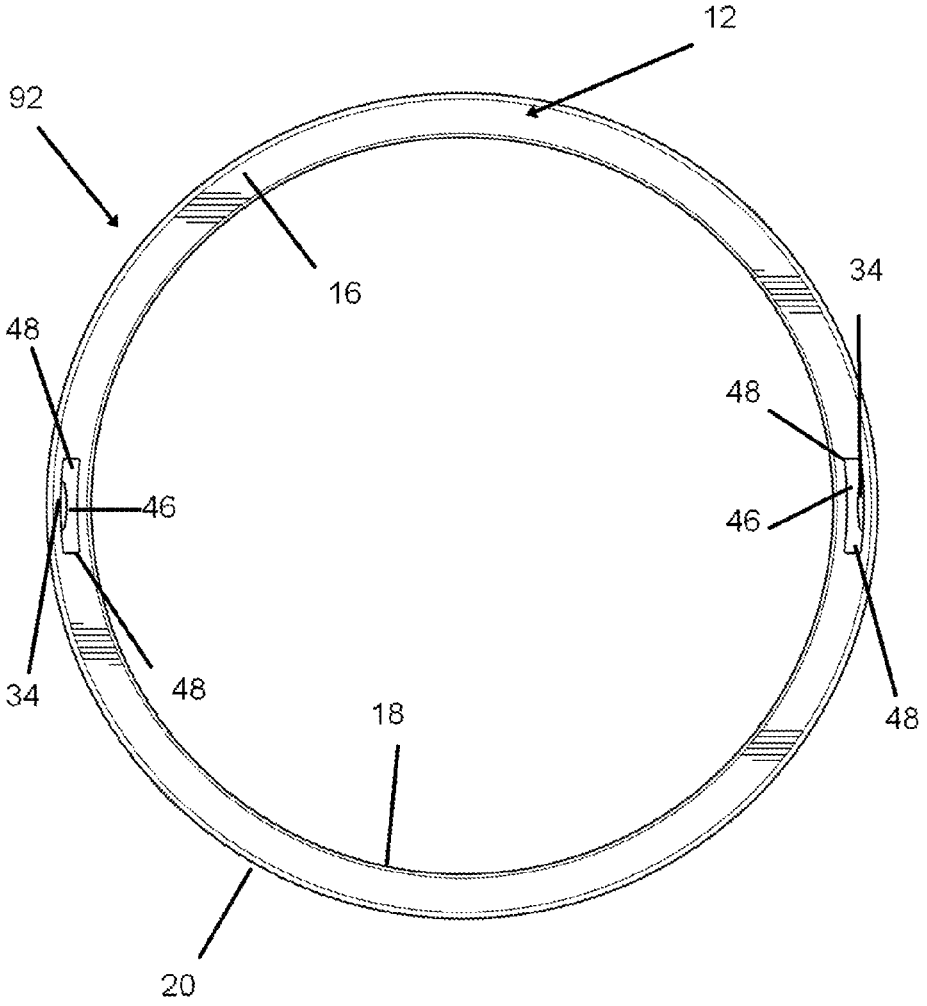
FIG. 14 is a top view of the ring shown in FIG. 13.

Referring now to FIGS. 13 and 14, it is also possible to construct a ring in accordance with the invention without any tabs. This embodiment of a ring 92 is similar to the ring 70 shown in FIGS. 8 and 9 but is missing tabs 14. The bottom view of ring 92 is the same as the bottom view of ring 70 (FIG. 9). Ring 92 is used slightly differently than ring 70 in that there are no tabs to aid in placement of the ring 92 onto a container or removal of the ring 92 from engagement with a container. Nonetheless, the ring 92 is still engageable with the container by pressing the ring 92 against the projection of the container. The user can grasped the annular portion 12 of the ring 92 and press down on the upper wall 16 against the container 16. Removal of the ring 92 from the container is facilitated by grasping the annular portion 12 and lifting it upward, possibly by pushing the lower edge of the outer wall 20 upward.

The other rings disclosed herein, that include tabs 14, may also be fabricated without tabs.

Figure 15:
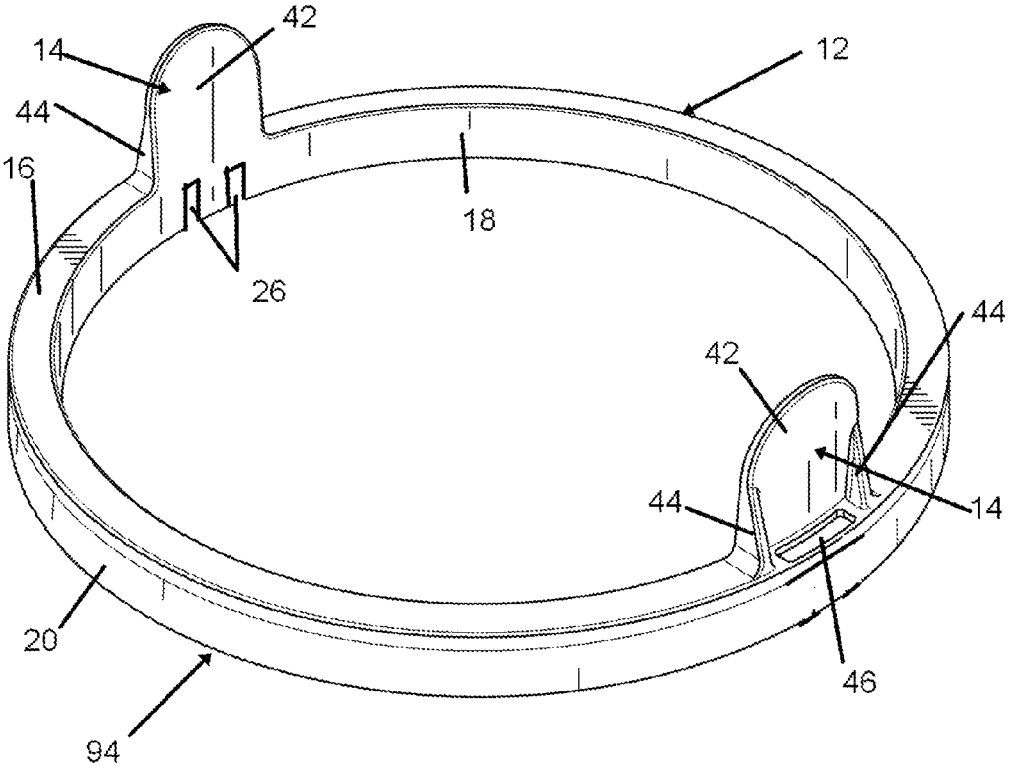
FIG. 15 is a perspective view of a seventh embodiment of a ring for securing a bag to a container in accordance with the invention.
Figure 16:
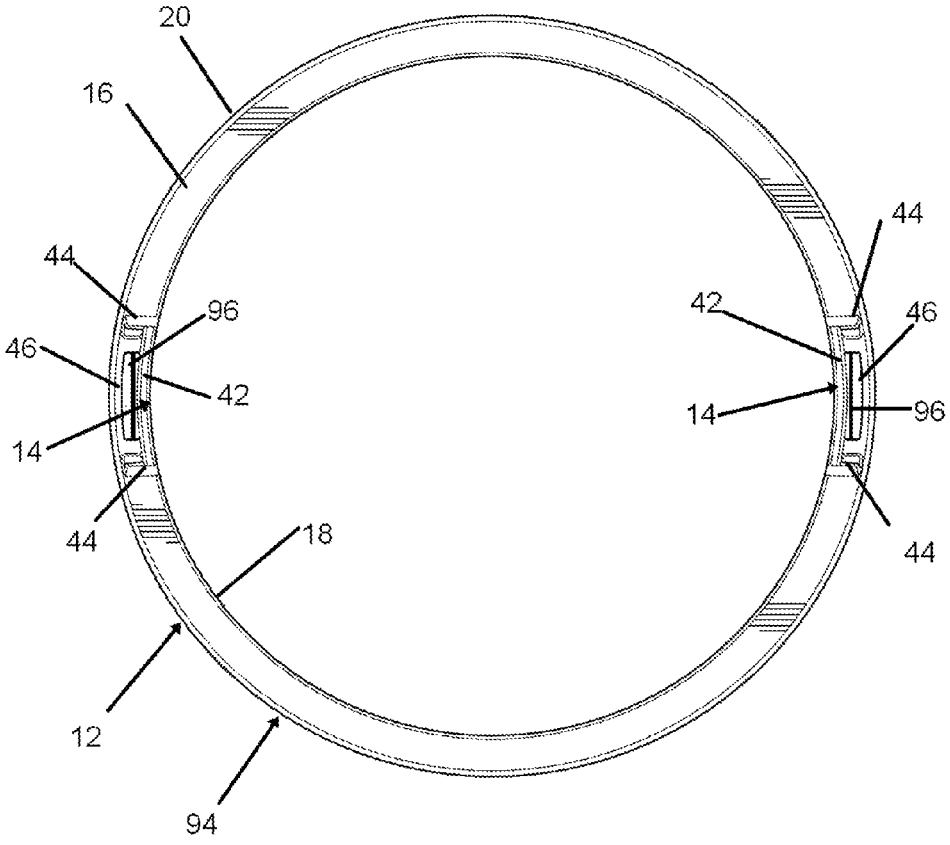
FIG. 16 is a top view of the ring shown in FIG. 15.
Figure 17:
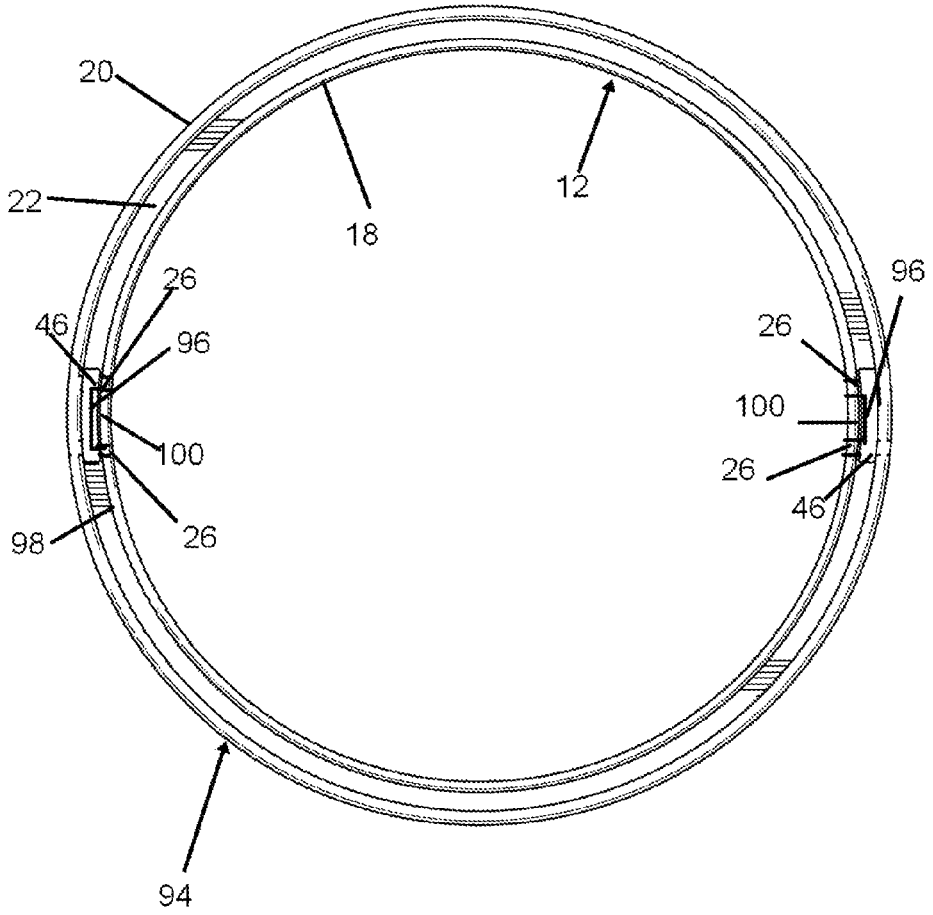
FIG. 17 is a bottom view of the ring shown in FIG. 15.
Figure 18:
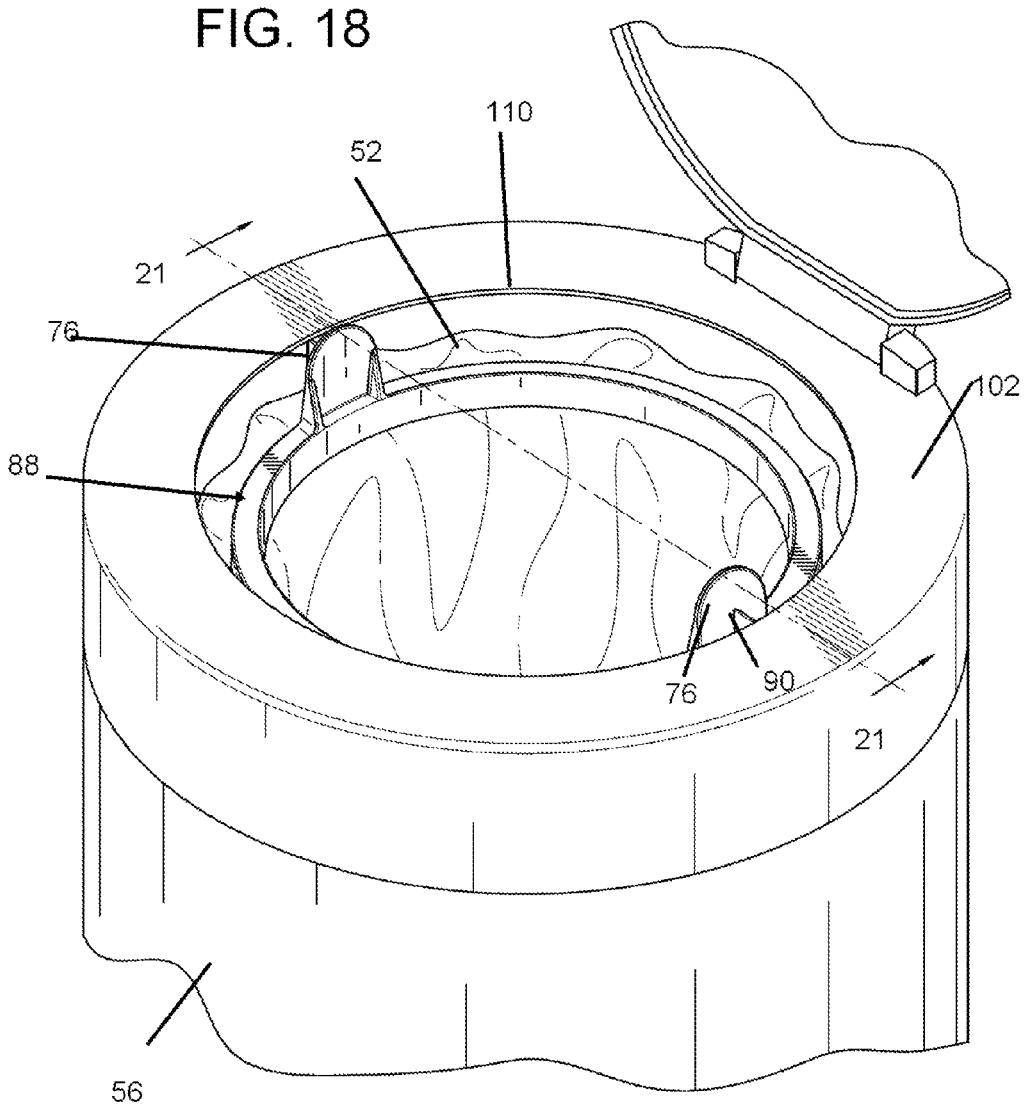
FIG. 18 is a perspective view of a container including a ring for securing a bag to a container in accordance with the invention including an extension rib.

Referring now to FIGS. 15-17, the position of the detent 34 is also not limited to the inner surface of the outer wall 20 as shown most clearly in FIGS. 3 and 9, and it could also be formed on the outer radial surface of the inner wall 18, i.e., that surface defining the channel 22. FIGS. 15-17 show a ring 94 which is similar to ring 60 shown in FIGS. 8 and 9 except that the slots 26 are formed on the inner wall 18 and a detent 96 is formed on the outer surface 98 of the inner wall 18 in that portion 100 between the slots 26 (see FIG. 17). It is also possible to form the detent 96 on the outer surface 98 of the inner wall 18 and the slots 26 on the outer wall 20, or vice versa. Detent 96 is shown as having a straight orientation along the inner surface 98 of the portion 100 between the slots 26 in the inner wall 18 (see FIG. 17). It could have a curved orientation or be formed as a horizontal or vertical rib.

The detent 34 could be a vertical rib on the outer surface of the inner wall 18, which may be substantially parallel with the slots 26 on the outer wall 20. In this position, the detent 34 will still serve its intended purpose and pinch a bag when present in the channel 22 and aid in keeping the bag from falling inward as it fills up with waste.

Detent 34 is therefore possibly constituted by a vertical or horizontal rib, a half round bump, or more generally, anything that can be formed where steel meets steel in an injection mold and can be released to form variations with little or preferably no interference when the part is cooled, opened and freely ejects the formed part.

As an aside, the detent 34 can be formed by any accumulation of material during the injection molding process in alignment with a shutoff opening 46, discussed below, that is formed by steel clamping down, ejecting thermoplastic material that in a reasonable time (e.g., between about 15 to about 30 seconds for example) cools and opens up to eject the part. As known to those skilled in injection molding manufacturing, straight up and down steel with a proper taper and no interference can thus form anything in the inner wall 18 or outer wall 20 from one or more detents 34 in parallel (or offset as long as there is a gap), one or more vertical lines parallel to the outer slots 26, a horizontal rib, or one that is interrupted, in parallel or offset (as long as there is a gap). It is even possible to have, for example, two, preferably vertical slots and one detent therebetween in the inner wall 18, as mentioned above.

It is also possible to have detents on both the inner and outer walls 18, 20 in order to create the best combination for balance and pinch. Common to all is the added pinch for positive further keeping the bag from falling inward as it fills up with waste.

FIGS. 18-21 show an embodiment similar to FIG. 12 wherein a ring 88 includes a support or extension rib 90 formed on the outer radial surface 78 of the tab 76, but does not include the pinches 24 (which are optional in this embodiment). Such an extension rib 90 may be formed on both tabs 76 as shown, or only one tab 76, and the extension rib 90 may also be used in the embodiment of FIG. 12, and any of the other embodiments disclosed herein. The purpose of the extension rib 90 is to enhance the securing of the bag 52 against the support 54 (see FIG. 21).

Figure 19:
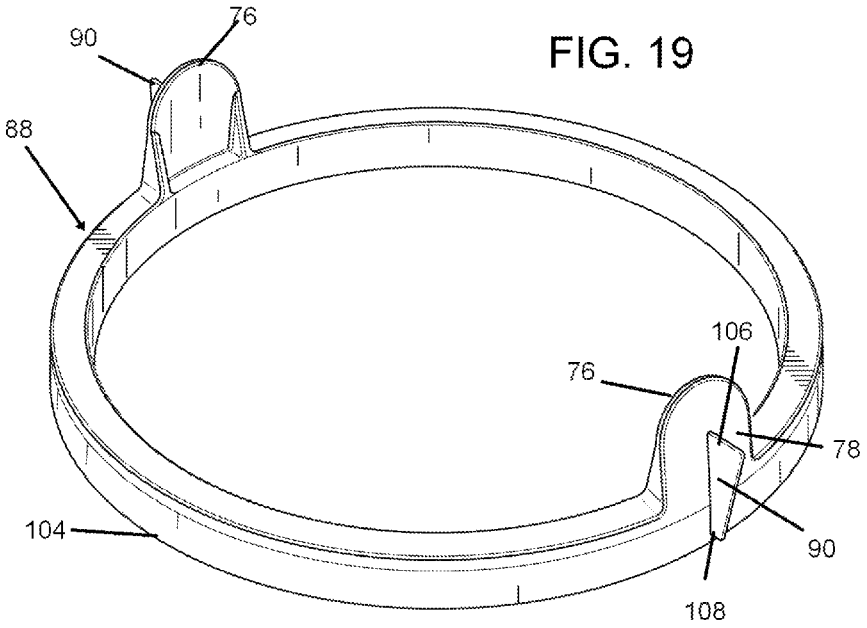
FIG. 19 is a perspective view of the ring shown in FIG. 18.
Figure 20:
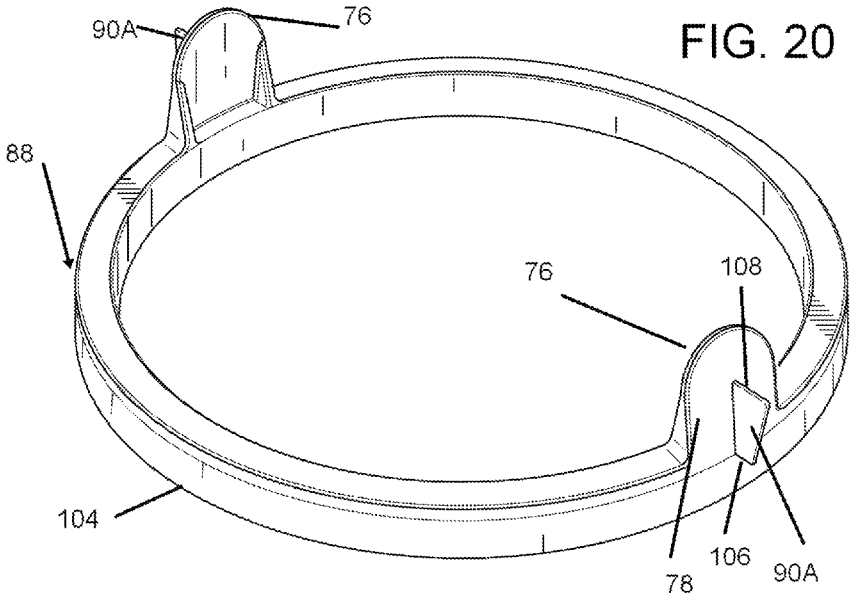
FIG. 20 is a perspective view of another embodiment of a ring for use in, for example, the container shown in FIG. 18.

The extension rib 90 may extend along a portion of the outer radial surface 78 of the tab 76, from a lower edge region (but not starting at the lower edge 104) upward to a location proximate to but not entirely at the upper edge of the outer radial surface 78 of the tab 76 (as shown in FIG. 19). Alternatively, the extension rib 90A may extend along a portion of the outer radial surface 78 of the tab 76 from a location above the outer wall 20 to a location proximate to but not entirely at the upper edge of the outer radial surface 78 of the tab 76 (as shown in FIG. 20).

Alternatively, the extension rib 90 may extend along a portion of the outer radial surface 78 of the tab 76, from the lower edge 104 upward to a location proximate to but not entirely at the upper edge of the outer radial surface 78 of the tab 76. In this embodiment, the extension rib 90 will be pressed by a pail top 102 of the waste container 56 against a portion of the bag 52 that is draped over the projection 58 onto the upper surface of the support 54. The extension rib 90 snaps under the opening of the pail top 102 and engages with the bag 52 to exert pressure against the bag 52 to trap it against the support 54, e.g., a positive trapping of the bag 52.

The extension rib 90 may extend only from the upper wall 16 upward to a location proximate to but not entirely at the upper edge of the outer radial surface 78 of the tab 76. The size of the extension rib 90, its height, width and length, are designed to prevent interference with the ability of the pinch 24 to flex outward when the tab 76 is pressed inward.

Figure 21:
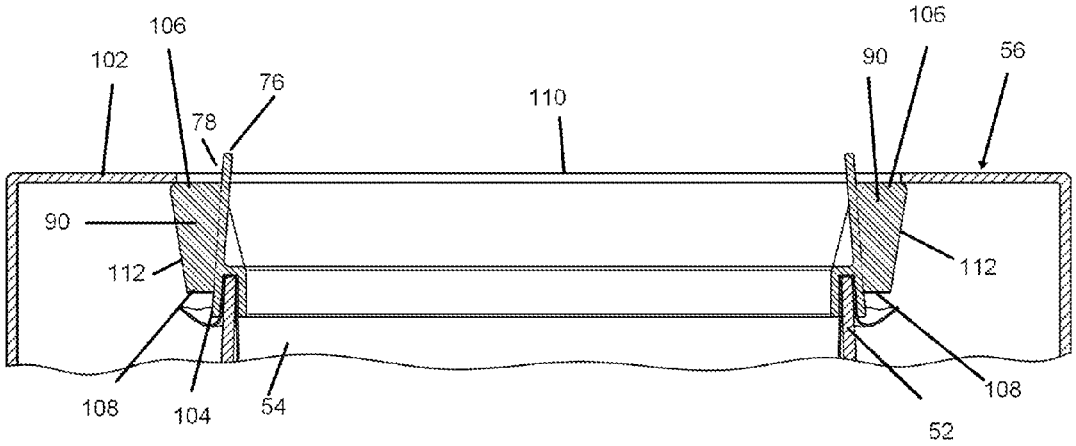
FIG. 21 is a cross-sectional view of the container with the ring shown in FIG. 18 taken along the line 21-21 in FIG. 18.

Extension rib 90 is tapered, i.e., the length in the radial direction at the top 106 of the extension rib 90 is the largest and is gradually reduced to a lowest length in the radial direction at the bottom 108 of the extension rib 90 (see the tapered edge 112 in FIG. 21). Tapering of edge 112 enables the ring 88 to enter the pail opening freely, i.e., it can enter into a hole 110 in the pail or container 56 into which the ring 88 will be seated without interference. Once fully entered, the extension rib 90 is often able to snap fractionally under the pail openings and thus put pressure downward on the bag, etc. (see FIG. 21). A small, optional and maybe not necessary, radius in the upper region of the extension rib 90, i.e., at the top 106 of the extension rib 90 where it has the largest length in the radial direction, could improve release of the ring 88 when squeezing the tabs 76 inward.

As shown in FIGS. 18-21, there are two extension ribs 90, 90A on opposite side of the ring 88. There may be any number of extension ribs 90, 90A, from a minimum of two, to stably support the pail top 102 of the container 56. Additional extension ribs 90, 90A may be useful, but are not required.

Rings 10, 70, 72, 74, 86, 88, 92, 94 may have a unitary construction, and be formed from a single piece of homogeneous material. The injection molding method of manufacture described above is one such technique that enables the ring 10 in its entirety to be formed as a single piece during manufacture.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A ring for securing a bag to a support in a container, comprising:

an annular portion including an upper wall, an inner circumferential wall extending downward from an inner edge region of said upper wall and an outer circumferential wall extending downward from an outer edge region of said upper wall, an annular channel being defined on an underside of said annular portion by said inner circumferential wall, said outer circumferential wall and said upper wall;

at least one pinch, each of said at least one pinch being on said inner circumferential wall and including a pair of slots extending upward from a lower edge of said inner circumferential wall or on said outer circumferential wall and including a pair of slots extending upward from a lower edge of said outer circumferential wall, said slots of each of said at least one pinch being spaced apart from one another to enable a solid portion of said inner circumferential wall or said outer circumferential wall between said slots to temporarily flex outward relative to said annular channel; and at least one upright tab each connected to said annular portion and extending at least partly upward above said upper wall, said annular portion being movable by grasping said at least one upright tab, each of said at least one upright tab being associated with a respective one of said at least one pinch and including a flange and two supports for supporting said flange on said upper wall, said upper wall including an opening above said at least one pinch and between said supports.

2. The ring of claim 1, wherein said annular portion is circular.

3. The ring of claim 1, wherein said slots of each of said at least one pinch are parallel to one another.

4. The ring of claim 1, wherein said slots of each of said at least one pinch extend from said lower edge of said inner circumferential wall or said outer circumferential wall only partly to said upper wall.

5. The ring of claim 1, wherein said at least one pinch is on said outer circumferential wall, further comprising a respective detent on an inner surface of said outer circumferential wall in a portion of said outer circumferential wall between said slots of each of said at least one pinch, said detent projecting inward from said outer circumferential wall into said annular channel.

6. The ring of claim 1, wherein said at least one pinch is on said inner circumferential wall, further comprising a respective detent on an outer surface of said inner circumferential wall in a portion of said inner circumferential wall between said slots of each of said at least one pinch, said detent projecting outward from said inner circumferential wall into said annular channel.

7. The ring of claim 1, wherein said at least one upright tab extends from an upper surface of said upper wall in an upward direction, said annular portion having a first state engaged with the support and a second state entirely free of the support and being movable between the first and second states by grasping said at least one upright tab.

8. The ring of claim 1, wherein said at least one upright tab comprises two upright tabs diametrically opposite one another or three upright tabs spaced equiangularly around said annular portion.

9. The ring of claim 1, wherein said flange has an outer surface contiguous with an outer surface of said outer circumferential wall, and each of said at least one upright tab further including supports extending radially inward from said flange to an inner edge region of said upper wall proximate said inner circumferential wall.

10. A ring for securing a bag to a support in a container, comprising:

an annular portion including an upper wall, an inner circumferential wall extending downward from an inner edge region of said upper wall and an outer circumferential wall extending downward from an outer edge region of said upper wall, an annular channel being defined on an underside of said annular portion by said inner circumferential wall, said outer circumferential wall and said upper wall;

at least one pinch, each of said at least one pinch being on said inner circumferential wall and including a pair of slots extending upward from a lower edge of said inner circumferential wall or on said outer circumferential wall and including a pair of slots extending upward from a lower edge of said outer circumferential wall, said slots of each of said at least one pinch being spaced apart from one another to enable a solid portion of said inner circumferential wall or said outer circumferential wall between said slots to temporarily flex outward relative to said annular channel; and at least one upright tab each connected to said annular portion and extending at least partly upward above said upper wall, said annular portion being movable by grasping said at least one upright tab, said at least one upright tab including a flange having an inner surface contiguous with an inner surface of said inner circumferential wall, and supports extending radially outward from said flange to an outer edge region of said upper wall proximate said outer circumferential wall.

11. The ring of claim 10, wherein said at least one pinch is on said outer circumferential wall, further comprising a respective detent on an inner surface of said outer circumferential wall in a portion of said outer circumferential wall between said slots of each of said at least one pinch, said detent projecting inward from said outer circumferential wall into said annular channel.

12. The ring of claim 10, wherein said at least one upright tab comprises two upright tabs diametrically opposite one another or three upright tabs spaced equiangularly around said annular portion.

13. In combination, a waste container having a support for supporting a bag-securing member and a ring for securing a bag to the support by securing the bag to a projection of the support, the ring comprising:

an annular portion including an upper wall, an inner circumferential wall extending downward from an inner edge region of said upper wall and an outer circumferential wall extending downward from an outer edge region of said upper wall, an annular channel being defined on an underside of said annular portion between said inner circumferential wall, said outer circumferential wall and said upper wall;

at least one pinch, each of said at least one pinch being on said inner circumferential wall and including a pair of slots extending upward from a lower edge of said inner circumferential wall or on said outer circumferential wall and including a pair of slots extending upward from a lower edge of said outer circumferential wall, said slots being spaced apart from one another to enable a solid portion of said inner circumferential wall or said outer circumferential wall between said slots to temporarily flex outward relative to said annular channel, said upper wall including a respective opening above each of said at least one pinch; and a respective detent associated with each of said at least one pinch, each respective detent projecting into said annular channel from an area between said slots of each of said at least one pinch, said annular portion being configured to press the bag against the support by trapping the bag in the annular channel and engaging with the support such that the projection of the support is pressed into the annular channel to thereby sandwich the bag between the projection and the annular portion.

14. The combination of claim 13, wherein said annular portion of the ring is circular.

15. The combination of claim 13, wherein said slots of each of said at least one pinch extend from said lower edge of said inner circumferential wall or said outer circumferential wall only partly to said upper wall.

16. The combination of claim 13, wherein said at least one pinch is on said outer circumferential wall and each respective detent is arranged on an inner surface of said outer circumferential wall in a portion of said outer circumferential wall between said slots of each of said at least one pinch, said detent projecting inward from said outer circumferential wall into said annular channel.

17. The combination of claim 13, wherein said at least one pinch is on said inner circumferential wall and each respective detent is arranged on an outer surface of said inner circumferential wall in a portion of said inner circumferential wall between said slots of each of said at least one pinch, said detent being situated along a lower edge of said portion of said inner circumferential wall between said slots and projecting outward from said inner circumferential wall into said annular channel.

18. The combination of claim 13, wherein the ring further comprises at least one upright tab each connected to and extending from an upper surface of said upper wall in an upward direction, said annular portion having a first state engaged with the support and a second state entirely free of the support and being movable between the first and second states by grasping said at least one upright tab.

19. The combination of claim 18, wherein each of said at least one upright tab is associated with a respective one of said at least one pinch and includes a flange and two supports for supporting said flange on said upper wall, said opening above said at least one pinch in said upper wall being between said supports.

20. The combination of claim 18, wherein said at least one upright tab includes:

a flange having an inner surface contiguous with an inner surface of said inner circumferential wall, and supports extending radially outward from said flange to an outer edge region of said upper wall proximate said outer circumferential wall; or a flange having an outer surface contiguous with an outer surface of said outer circumferential wall, and supports extending radially inward from said flange to an inner edge region of said upper wall proximate said inner circumferential wall.

* * * * *